US005380089A

United States Patent [19]

Karasawa

[11] Patent Number: 5,380,089

[45] Date of Patent: Jan. 10, 1995

[54] EMULSIFYING APPARATUS FOR SOLID-LIQUID MULTIPHASE FLOW AND NOZZLE FOR SOLID-LIQUID MULTIPHASE FLOW

[76] Inventor: Yukihiko Karasawa, 3-27, Oaza-Minami-Nakano, Ohmiya-shi, Saitama 330, Japan

[21] Appl. No.: 98,502

[22] Filed: Jul. 28, 1993

[30] Foreign Application Priority Data

Jul. 29, 1992 [JP] Japan ..... 4-202695

[51] Int. Cl.[6] ..... B01F 15/02

[52] U.S. Cl. ..... 366/176; 137/602; 137/896; 366/340

[58] Field of Search ..... 366/176, 336, 337, 340, 366/338, 150; 137/602, 896, 897

[56] References Cited

U.S. PATENT DOCUMENTS

| | | | |
|---|---|---|---|
| 2,890,868 | 6/1959 | Potchen | 366/336 |
| 4,505,592 | 3/1985 | Ihbe | 366/176 |
| 4,533,254 | 8/1985 | Cook | 366/340 |

*Primary Examiner*—Robert W. Jenkins

*Attorney, Agent, or Firm*—Kuhn and Muller

[57] ABSTRACT

An emulsifying apparatus for solid-liquid multiphase flow and a nozzle for solid-liquid multiphase flow, whereby, in a high pressure vessel, there is provided a plate member made of a material with high hardness and having a through-hole sufficiently small compared with a passage of fluids in the high pressure vessel. An outflow passage perpendicular to the through-hole is communicated to a side of the plate member at the center of the through-hole of the plate member, the through-hole of the plate member forms an orifice, cross-sectional area of said orifice, obtained by cutting central axis of the passage by a vertical plane, being gradually reduced from inlet of the nozzle toward the center, and there is provided an area without particles from a portion with minimum orifice diameter toward the center, and an orifice is provided, cross-sectional area of said orifice, obtained by cutting central axis of flow passage by a vertical plane, being gradually reduced from inlet toward the outlet of the nozzle, and there is provided an area without particles from a portion with minimum orifice diameter toward the outlet.

6 Claims, 5 Drawing Sheets

FIG. 3A
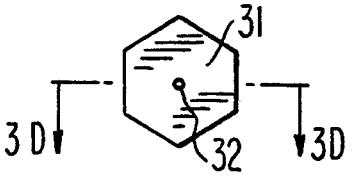
FIG. 3B
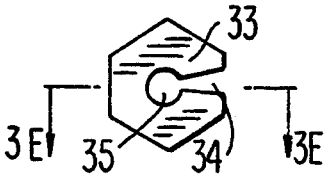
FIG. 3C
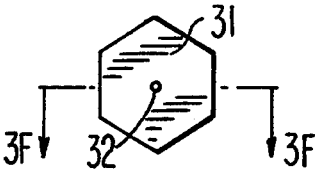
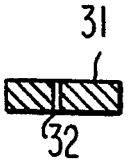
FIG. 3D
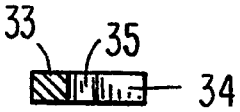
FIG. 3E
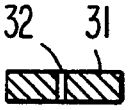
FIG. 3F
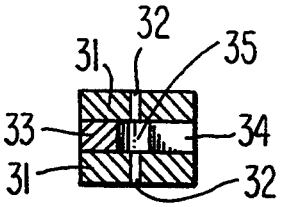
FIG. 3G
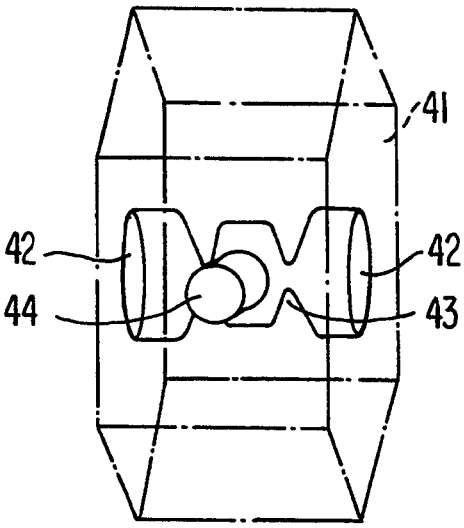
FIG. 4

FIG.9A
PRIOR ART
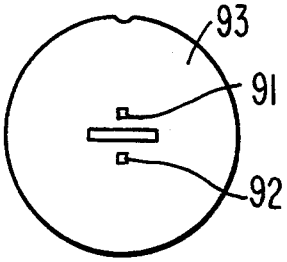
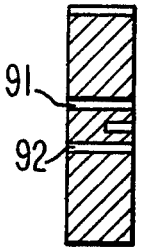
FIG.9D
PRIOR ART
FIG.9B
PRIOR ART
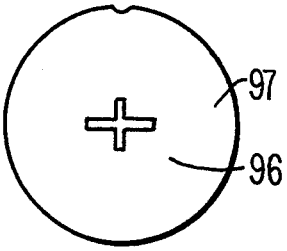
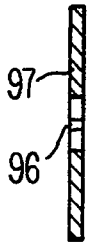
FIG.9E
PRIOR ART
FIG.9C
PRIOR ART
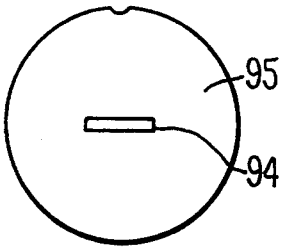
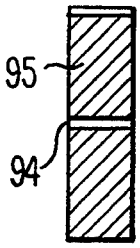
FIG.9F
PRIOR ART
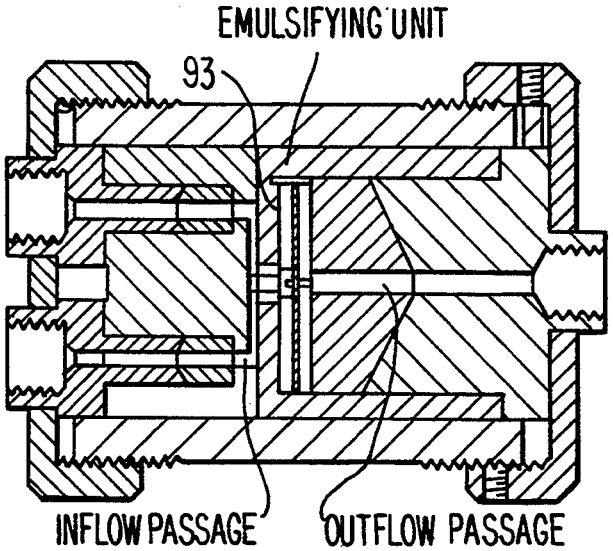
FIG. 9G
PRIOR ART

EMULSIFYING APPARATUS FOR SOLID-LIQUID MULTIPHASE FLOW AND NOZZLE FOR SOLID-LIQUID MULTIPHASE FLOW

BACKGROUND OF THE INVENTION

The present invention relates to an emulsifying apparatus for a solid-liquid multiphase flow where non-mixable substances such as water and oil or fine particles are dispersed in a liquid, and also to a nozzle for the solid-liquid multiphase flow.

The emulsifying apparatus is widely used for dispersing and homogenizing raw material liquid and particles in the processes for manufacturing paint, pigment, ink, medical drug, photosensitive material, magnetic recording medium, etc.

Various types of emulsifying apparatuses are known. In order to obtain the products with higher degree of emulsification or dispersion, apparatuses such as sand grinder, high strength shearing disperser, colloid mill, ultrasonic disperser, etc. are used.

However, in the emulsification by these apparatuses, it is difficult to obtain emulsified products containing ultra-fine particles or emulsified products containing few agglutinated particles. To solve the problem, various types of apparatuses have been proposed, which emulsify fluids by making them collide with each other. The Japanese Patent Laid-Open Publication No. 61-238330 describes an emulsifying apparatus, in which two inflow passages and one outflow passage, are provided using pipes, and fluids are supplied at high speed from the two inflow passages to collide with each other, while it is not possible to obtain highly dispersed fluid by an apparatus composed of pipes.

U.S. Pat. No. 4,533,254 proposes an emulsifying apparatus, in which groove-shaped passages 81 and 82 are formed as shown in FIG. 8 and a shim 83 is arranged to hold an opposite member 84 with a spacing and to form an opening 85. The fluids introduced through the groove-shaped passage collide with each other.

In the U.S. patent application Ser. No. 919,859, an emulsifying apparatus is proposed as shown in FIGS. 9A–9G, in which an inflow side plate member 93 provided with inlets 91 and 92 and an outflow side plate member 95 provided with a groove-shaped through-hole 94 are laminated with an intermediate plate member 97 with a crossed channel 96. The fluids to be emulsified are introduced under high pressure through the inlets on the inflow side plate member., and after turning the direction of the flow at right angle, the fluids collide with each other in a channel formed between a groove and the plate member, and the fluids are then passed from intersection of the grooves into a channel consisting of grooves on the opposite plate member.

In these prior art apparatuses, it is possible to obtain emulsified liquid better than those obtained by conventional type apparatuses. Although used practically on trial basis, there are problems in durability of the plate member, and it is difficult to design a large size apparatus.

In the emulsifying apparatuses shown in FIG. 8 and FIG. 9A–9G, emulsification is carried out by changing flow passages of the fluids to be emulsified, and the fluids change the directions and repeatedly collide with wall of the passage before the fluids are emulsified and dispersed by colliding energy. During such collision, energy is released, and high force is applied on wall surface, as in cutting operation, at the points where the fluids of the plate members change the directions.

For this reason, the plate member is made of super-hard material with high hardness to prevent the damage due to fluid under ultra-high pressure. However, even super-hard material cannot endure the wearing caused by long-term use and damage is unavoidable, and this causes serious problem in the durability of the apparatus.

In the emulsifying and dispersing apparatus as described above or in fabricating method using abrasive water jet of super-hard material containing abrasive material in high pressure jet, a nozzle is used to inject a solid-liquid multiphase flow at high speed.

FIG. 10 represents an example of a nozzle for the abrasive water jet. In a mixing chamber 15, high pressure water is introduced via a water nozzle 16. From an abrasive material inlet 17, an abrasive material 18 is sucked by negative pressure generated in the mixing chamber and is injected from a nozzle 19 together with high speed water, and the workpiece is cut off or ground. Even when the nozzle is made of a material with high hardness, it is worn out and damaged extensively as high pressure flow mixed with abrasive material passes through, and it is necessary to frequently replace the nozzle.

SUMMARY OF THE INVENTION

In an apparatus for emulsifying and dispersing a solid-liquid multiphase flow according to the present invention, a thin plate member having a through-hole with diameter smaller than that of a passage of fluids in a high pressure container is arranged in said high pressure container, an outflow passage perpendicular to the through-hole is communicated with a side of the plate member at the center of the through-hole of the plate member, and the fluids supplied from opposite directions of the through-hole of an emulsifying unit collide with each other and are emulsified at the center of the plate member.

The plate member for emulsifying and dispersing may be integrally formed, or a groove extending toward the side of each plate member from the through-hole at the center of two plate members may be formed on the surface of the plate members, and the grooves of two plate members may be over-lapped to form an outlet from the through-hole. The emulsifying and dispersing unit can be formed by overlapping the two plate members. Thus, it is possible to easily fabricate through-hole or grooves on each member of the emulsifying unit, and this facilitates the manufacture of the apparatus.

The diameter of the portion where fluids collide at high speed is designed smaller than the diameter of the channel where fluids flow under high pressure, and the portion where the fluids pass at high speed is designed in form of straight line, and the length of the portion where the pressure is changed to flow velocity is designed shorter. Thus, it is possible to minimize energy loss at the collision of the fluids with wall of the container and also to increase durability of the members where emulsification and dispersion are performed.

In the nozzle for solid-liquid multiphase flow in the emulsifying apparatus for high speed solid-liquid multiphase flow, or for abrasive water jest, etc., an orifice is arranged, and cross-sectional area of said orifice, cut through by a plane perpendicular to central axis of the nozzle, is gradually reduced from inlet to outlet of the nozzle, and an area is formed where there exist no particles from a portion with minimum orifice diameter toward the outlet.

Specifically, the conventional type nozzle comprises a channel, which has a constant cross-sectional area as shown in FIG. 7. In such nozzle, inner surface of the nozzle is worn out earlier by abrasive material. In the nozzle of the present invention, the orifice is provided in the nozzle where the fluids pass through at high speed, and cross-sectional area of said orifice is gradually decreased to the minimum cross-sectional area of the orifice. As the result, flow velocity in the surrounding area is slower than flow velocity at the center of the fluids passing through the orifice. Thus, there is an area without particles within the nozzle. By Forming wall surface of the nozzle along the boundary particle flow curve between the portion with particles and the portion without particles, it is possible to obtain a nozzle, in which wall surface will not be worn out.

BRIEF DESCRIPTION OF THE DRAWINGS

FIGS. 3A–3G detailed structure of an example of an emulsifying unit where three members are laminated. FIGS. 3A–C represent plan views of component members, and FIGS. 3D–F show cross-sectional views taken along lines 3D, 3E and 3F respectively of FIGS. 3A, 3B and 3C respectively. FIG. 3G is an emulsifying unit where an intermediate member is laminated between end members.

FIG. 4 is a perspective view of another embodiment of the emulsifying unit;

FIG. 8 and FIG. 9 show prior art conventional type emulsifying apparatuses.

DESCRIPTION OF THE PREFERRED EMBODIMENTS

Figure 1:
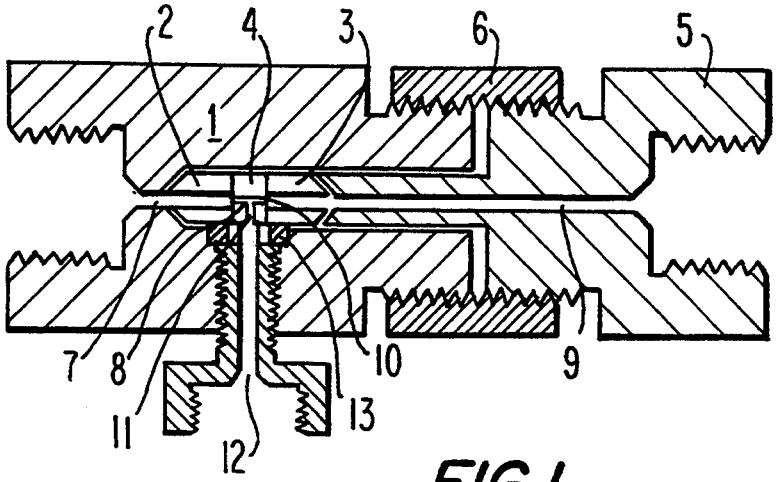
FIG. 1 shows an embodiment of an emulsifying apparatus of the present invention.

As shown in FIG. 1, the emulsifying apparatus of the present invention comprises a pressure vessel main unit 1, which endures high pressure fluid supplied to the emulsifying apparatus, an emulsifying unit 4 is arranged between metal seals 2 and 3 within a space inside the main unit, and a conversion coupling 5 is tightened by a coupler 6 with right-hand thread and left-hand thread.

One of the fluids to be emulsified is pressurized by a high pressure pump and is introduced into an inlet of the emulsifying unit having inner diameter smaller than inflow passage from the inflow passage 7 of the pressure vessel main unit. The other fluid is supplied from an inflow passage 9 on conversion coupling side through metal seal to an inlet 10 of the emulsifying unit with smaller inner diameter. By collision of the fluids supplied at high speed from opposite directions, emulsification and dispersion occur. The emulsified and dispersed fluid passes through an outlet 11 and is discharged through an outlet passage 12.

By tightening force of the conversion coupling in the high pressure vessel, the emulsifying unit is brought into surface contact with planar portion of the metal seal to keep tight sealing condition. On the other hand, leakage is prevented on the outlet of the emulsifying unit by an O-ring 13.

Figure 2A:
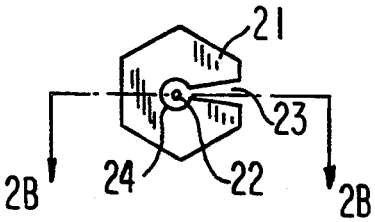
FIGS. 2A, 2B and 2C show an embodiment of an emulsifying unit of the emulsifying apparatus of the present invention.
Figure 2C:
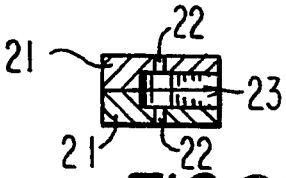
Figure 2B:
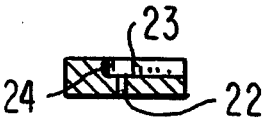

FIG. 2A, 2B, 2C shows detailed structure of an example of the emulsifying unit comprising two members. FIG. 2A is a plan view of the emulsifying unit main body, and FIG. 2B is a cross-sectional view along the line 2B—2B of FIG. 2. FIG. 2C represents the emulsifying unit having two emulsifying unit main bodies with the identical structure tied together. The emulsifying unit main body is provided with a through-hole 22 and with a groove 23 serving as an outlet. Also, the emulsifying unit main body has an extended portion 24 with larger diameter on the side opposite to the outlet of the through-hole in order to equalize dispersion, pulverizing and emulsification and also to minimize damage of the emulsifying unit due to collision of the fluid to be emulsified and dispersed against wall surface.

FIG. 3A–3G shows detailed structure of an example of an emulsifying unit where three members are laminated. FIGS. 3A, 3B and 3C represent plan views of component members, and FIGS. 3D, 3E and 3F are cross-sectional views along the lines 3D, 3E and 3F respectively. FIG. 3G shows an emulsifying unit where an intermediate member is laminated between end members.

On an end plate 31 of the emulsifying unit, a through-hole is formed, and an outlet 34 and an extended portion 34 are provided on an intermediate plate 33 to minimize damage of the emulsifying unit due to collision of the fluid to be emulsified and dispersed against wall surface.

Further, FIG. 4 is a perspective view of another embodiment of the emulsifying unit. The emulsifying unit main body 41 comprises diamond plate members overlapped on each other. The emulsifying unit main body is provided with inlets 42 having nozzles, in which cross-sectional area of flow passage is gradually decreased toward minimum cross-sectional area of an orifice 43. Solid-liquid multiphase flow passing through the orifice at high speed collides with each other and emulsification and dispersion occur, and it is discharged from an outlet 44. Compared with an emulsifying unit with straight orifice, the nozzle of the above shape can prevent wearing due to contact of the solid-liquid multiphase flow with wall surface.

The effect of dispersion and emulsification by collision of fluids depends upon the type of fluid. In most cases, it is effective at the pressure of 400 kg/cm$^2$ or more and at flow velocity of 86 m/sec. or more. To maintain such pressure and flow velocity through a long orifice means low corrosion resistance.

For example, in a small-scale mass production apparatus with flow rate of 4.5 liters per minute, Table 1 shows the relationship of pressure orifice diameter and flow velocity at room temperature in case of water.

TABLE 1

| | Condition 1 | Condition 2 | Condition 2 | Condition 3 | Condition 4 |
|---|---|---|---|---|---|
| Pressure (kg/cm$^2$) | 1400 | 2500 | 3500 | 4200 | 7000 |
| Orifice dia. (mm) | 0.51 | 0.43 | 0.41 | 0.38 | 0.27 |
| Flow velocity | 370 | 490 | 585 | 643 | 930 |

TABLE 1-continued

| | Condition 1 | Condition 2 | Condition 2 | Condition 3 | Condition 4 |
|---|---|---|---|---|---|
| (m/sec) | | | | | |

On the other hand, pressure loss Δp (kgf/cm²) at the orifice is obtained by the following equation:

$$d\ \Delta p=\gamma\times\lambda\times(L/d)\times(V^2/2g)\times10^{-4}$$

where $\gamma$=specific weight (in case of water $1\times10^3$ kgf/cm²), $\lambda$=friction coefficient in pipe. L=orifice length, d=orifice diameter, V=velocity in pipe (m/sec), and g=9.8 m/sec².

Under the conditions shown in Table 1, an orifice (A) of 3.5 mm in length and an orifice (B) of 12 mm in length, both made of sintered diamond with surface finish, show pressure loss as given in Table 2.

TABLE 2

| | | Condition 1 | Condition 2 | Condition 2 | Condition 3 | Condition 4 |
|---|---|---|---|---|---|---|
| (A) | Pressure loss (kgf/cm²) | 96 | 196 | 300 | 390 | 1144 |
| | Pressure loss ratio (%) | 6.9 | 7.8 | 8.6 | 9.3 | 16.3 |
| (B) | Pressure loss (kgf/cm²) | 330 | 675 | 1040 | 1350 | 3922 |
| | Pressure loss ratio (%) | 23.6 | 270 | 29.7 | 32.1 | 56.0 |

As it is evident from the above, it is preferable that the orifice is 12 mm in length at the longest for effective emulsification and dispersion. On the other hand, it is necessary to provide a hole crossing perpendicularly to the through-hole in addition to the through-hole on the emulsifying unit. Thus, it is not possible to reduce the length of orifice. In case it is formed by an integral member, the length is about 2 mm at the highest. In case grooves are fabricated on the surface of two members, it is 3.5 mm at the highest.

In case the flow at the orifice is changed, the pressure loss Δp generated at this moment is:

$$\Delta p=f_{b\ e}\times(V^2/2\ g)\times10^{-1},$$

where $f_{b\ e}$=bending loss coefficient (in case of 90 degrees: 0.99), V=speed in pipe (m/sec), and g=9.8 m/sec².

Pressure loss under each of the above conditions is as follows:

TABLE 3

| | Condition 1 | Condition 2 | Condition 2 | Condition 3 | Condition 4 |
|---|---|---|---|---|---|
| Bending pressure loss (kgf/cm²) | 680 | 1220 | 1740 | 2100 | 4300 |

Figure 8:
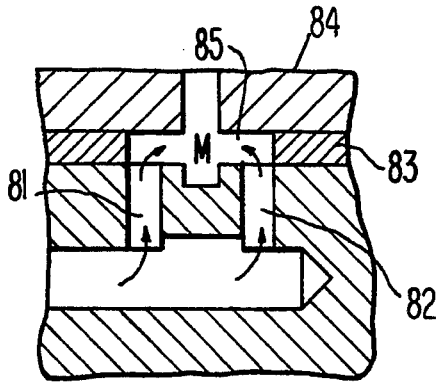
FIG.8 PRIOR ART
Figure 10:
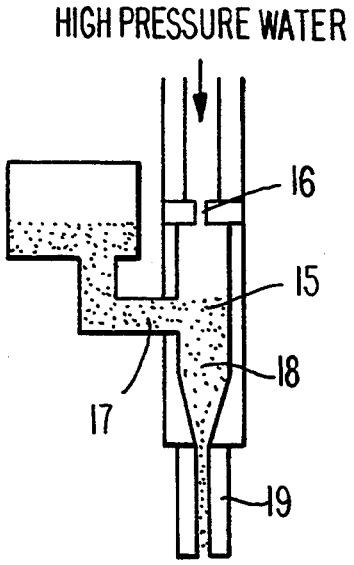
FIG. 10 represents an example of a nozzle for abrasive water jet.

Therefore, in the conventional type apparatuses of FIG. 8 and FIG. 9, pressure loss due to bending is high, while pressure loss in the apparatus of the present invention is low, and applied pressure is effectively utilized for emulsification and dispersion. Thus, efficient emulsification and dispersion can be accomplished.

The size of the outlet of the emulsifying unit is determined by the pressure loss of the piping to be connected after the present apparatus. Preferably, it is by 1.5–2 times as large as the size of the inlet. The extended portion on the emulsifying unit is preferably by 2–4 times as large as the cross-sectional area of the inlet.

In the apparatus of the present invention shown in FIG. 1, a passage of 3 mm in diameter and 10 mm in overall length is provided for the metal seals 2 and 3. In case the inflow passage is 5 mm in diameter and the pressure at metal seal is 3500 kg/cm², pressure loss is as low as about 8 kg/cm² on one side. Thus, it is possible to increase the flow velocity at the orifice, which forms an inlet after the inflow passage and to make the fluids collide with each other to induce collision of fluids and it is possible to achieve efficient emulsification and dispersion.

The component materials of the emulsifying unit must have high hardness, and the materials such as sintered diamond, diamond monocrystal, sapphire, tungsten carbide, etc. may be used. In case the emulsifying unit is made of diamond monocrystal, the inlet and the outlet are formed on diamond monocrystal and the emulsifying unit is integrally formed in order to emulsify and disperse the fluid, which may give serious damage to the emulsifying unit such as the fluid containing solid particles with high hardness.

Next, description will be given on the nozzle for solid-liquid multiphase flow, in which cross-sectional area of flow passage is gradually reduced toward the orifice. In a nozzle 51 of FIG. 5, an orifice 54 is formed between an inflow side 522 and an outflow side 53, and cross-sectional area of the passage is gradually reduced toward the orifice 54. In this example, a channel of 1 mm in size is formed on the inflow side, and the cross-sectional area of the channel is gradually reduced to the orifice diameter of 0.3 mm over the length of 0.52 mm.

Figure 5:
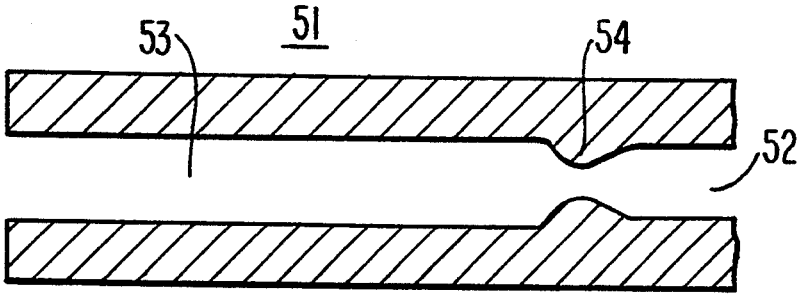
FIG. 5 shows a nozzle for solid-liquid multiphase flow according to the present invention.
Figure 6:
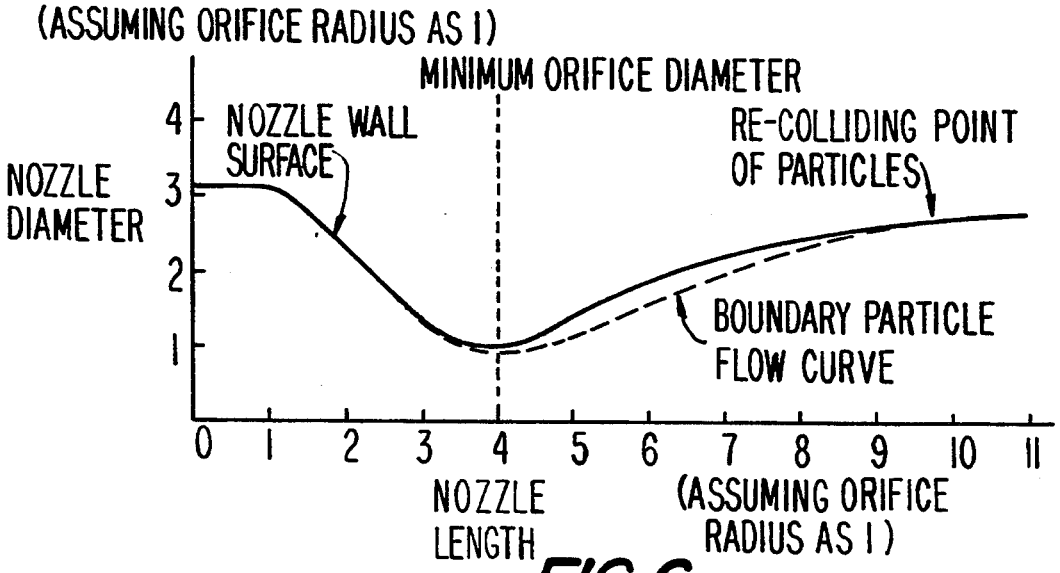
FIG. 6 shows boundary particle flow curve to form an area without particles by cross-sectional shape of an orifice of the nozzle of FIG. 5.

FIG. 6 shows boundary particle flow curve to form an area without particles by cross-sectional shape of nozzle and the orifice of FIG. 5. The length of nozzle, taking orifice radius as 1, is given on the axis of abscissa, and the diameter of the channel, taking orifice radius as 1, is given on the axis of ordinate. An area without particles is provided toward the outlet from nozzle orifice, and it is possible to prevent the wearing of nozzle by providing wall surface at a position separated from central axis beyond the boundary particle flow curve.

Figure 7:
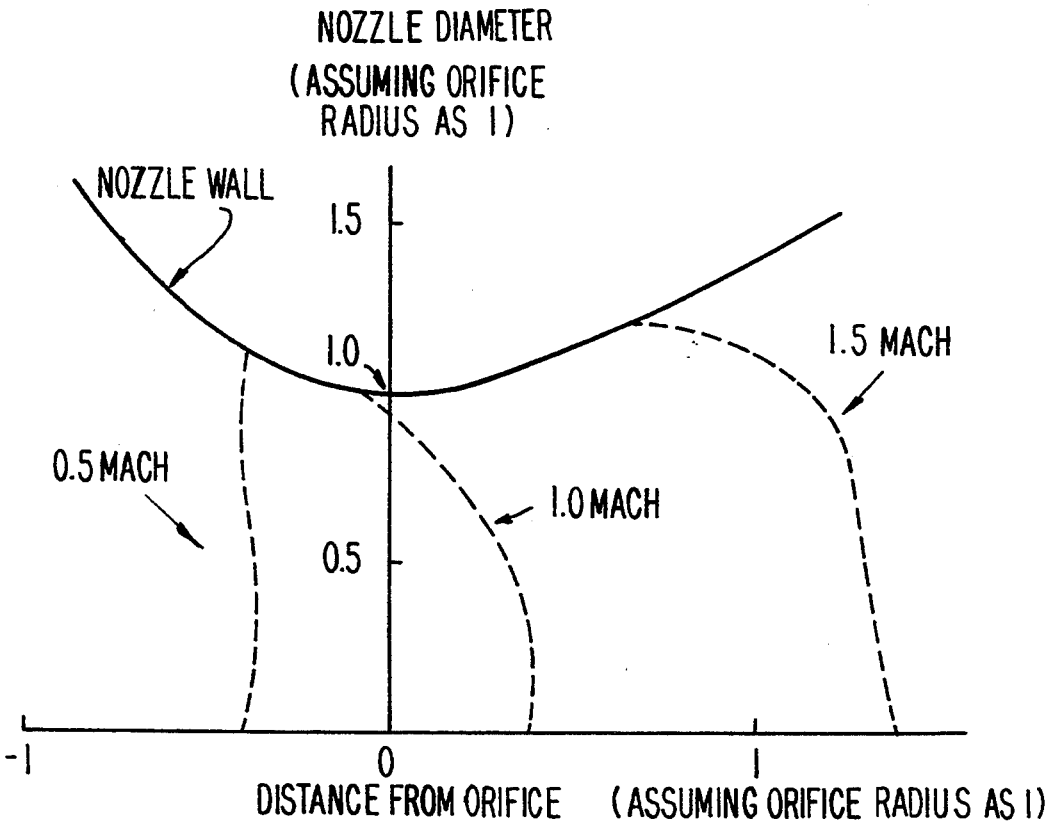
FIG. 7 represents an iso-Mach curve of a dispersion liquid with dispersed particles around the orifice.

FIG. 7 is an iso-Mach diagram of dispersion liquid with dispersed particles around the orifice. The distance having minimum orifice diameter as origin and taking minimum orifice radius as 1 is taken on the axis of abscissa, and nozzle diameter taking orifice radius as 1 is taken on the axis of ordinate. Dotted lines show iso-Mach curves. This is an iso-Mach diagram at 20° C. of solid-liquid two-phase flow containing water with garnet for adhesive material by 20 weight %.

In case a nozzle with cross-sectional area of the passage gradually reducing is used at the nozzle of the emulsifying unit of FIG. 4, the diameter of the inlet of the emulsifying unit is 0.5 mm, for example, and it is gradually reduced toward orifice diameter of 0.14 mm over the length of 0.3 mm, and curved surface is formed toward the center of the diameter of 0.31 mm. By this emulsifying unit, long-term operation can be achieved for solid-liquid dispersion flow at 30 liters per hour by the pressure of 700 kgf/cm².

What we claim is:

1. An emulsifying apparatus for emulsifying and dispersing a solid-liquid multiphase flow, wherein there is provided in a high pressure vessel an emulsifying unit comprising a plate member, said plate member having a through-hole, said through-hole having a diameter smaller than the diameter of the inflow passage of the metal seal contacting with the plate member, an outlet perpendicular to the through-hole communicating with a side of said plate member of the emulsifying unit at the center of said through-hole of the emulsifying unit, and wherein fluids supplied from opposite directions through said through-hole of the emulsifying unit collide with each other of said fluids at the center of the emulsifying unit and further wherein said fluids are emulsified.

2. An emulsifying apparatus according to claim 1, wherein the emulsifying unit comprises a plurality of plate members, and an outlet comprises a passage formed by a groove formed on one of said plate members and another plate member of said plurality of plate members.

3. An emulsifying apparatus according to claim 2, wherein an emulsifying unit includes two plate members being piled up with each other.

4. An emulsifying apparatus according to claim 2, wherein an emulsifying unit includes three plate members being piled up with each other, and an intermediate plate member thereof having a groove and a through-hole, said intermediate plate member being piled up with said other two plate members having only through-holes.

5. An emulsifying apparatus according to claim 1, wherein orifices are provided on said through-hole of the emulsifying unit, and wherein the cross-sectional area of said orifices being gradually reduced from an inlet to the portion of a minimum orifice diameter and said cross-sectional area being gradually increased from a portion of the minimum orifice diameter to the emulsifying portion, and the region having no particles in a portion downstream from said orifices.

6. A nozzle, through which a solid-liquid multiphase flow pass at high speed, whereby an orifice is formed, wherein there is provided a cross-sectional area of said orifice, said cross-sectional area being gradually reduced from the inlet to the portion of the minimum orifice diameter, and said cross-sectional area of said orifice being gradually increased from a portion of the minimum orifice diameter to the outlet of said plate member.

* * * * *